US008147277B1

(12) United States Patent
Wang et al.

(10) Patent No.: US 8,147,277 B1
(45) Date of Patent: Apr. 3, 2012

(54) ELECTRICAL CONNECTOR WITH HIGH SPEED AND LOW SPEED TRANSMISSION TERMINAL GROUPS

(75) Inventors: Yao-Ting Wang, Taipei (TW); Yu-Hung Su, Taipei (TW); Yeh-Ta Chien, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/950,155

(22) Filed: Nov. 19, 2010

(51) Int. Cl.
*H01R 24/00* (2011.01)
*H01R 13/73* (2006.01)

(52) U.S. Cl. ..... 439/660; 439/541.5

(58) Field of Classification Search ..... 439/660, 439/541.5, 79, 607.4
See application file for complete search history.

(56) References Cited

U.S. PATENT DOCUMENTS 6,106,338 A * 8/2000 Wu et al. ..... 439/660
7,604,490 B2 * 10/2009 Chen et al. ..... 439/79
7,651,371 B2 * 1/2010 Yi et al. ..... 439/541.5
7,731,535 B1 * 6/2010 Wan et al. ..... 439/607.4
7,837,499 B1 * 11/2010 Chen ..... 439/541.5
7,997,927 B2 * 8/2011 Wan et al. ..... 439/541.5
8,002,589 B1 * 8/2011 Yu et al. ..... 439/660
2004/0229502 A1 * 11/2004 Hu et al. ..... 439/541.5

* cited by examiner

*Primary Examiner* — Chandrika Prasad
(74) *Attorney, Agent, or Firm* — WPAT, P.C.; Anthony King

(57) ABSTRACT

An electrical connector includes an insulating body, a low-speed transmission terminal group including electrical terminals, a high-speed transmission terminal group including at least one outputting signal terminal and at least one receiving signal terminal, and a positioning body which has a fastening portion mounted under a rear of the insulating body and a positioning portion hanged behind the insulating body. Each of the terminals has a fastening strip, a contact portion and a soldering tail connected with two opposite ends of the fastening strip. The soldering tails of the outputting and receiving signal terminals protrude sideward to form eave boards broadening the outputting and receiving signal terminals for lowering the differential impedance of the high-speed transmission terminal group. The fastening strips are disposed in two opposite surfaces of the insulating body. The soldering tails and the eave boards stretch behind the insulating body to be positioned in the positioning portion.

11 Claims, 4 Drawing Sheets

ELECTRICAL CONNECTOR WITH HIGH SPEED AND LOW SPEED TRANSMISSION TERMINAL GROUPS

BACKGROUND OF THE INVENTION

1. Field of the Invention

The present invention relates to an electrical connector, and more particularly to an electrical connector having a compatibility of the high-speed signal transmission and the low-speed signal transmission.

2. The Related Art

Electronic products have developed rapidly over the past few decades, and peripheral equipments mating with the electronic products are also utilized with increasing frequency. A common connection mode for achieving signal transmission between the electronic products and the corresponding peripheral equipments is to use an electrical connector between the electronic products and the corresponding peripheral equipments. With the development of electronic technology, there is a higher and higher demand for the signal transmission speed between the electronic product and the corresponding peripheral equipment. So the traditional electrical connector which is used to achieve low-speed signal transmission at the start is further improved by extra adding a high-speed transmission terminal group therein so as to make the improved electrical connector compatibly realize the low-speed signal transmission and the high-speed signal transmission.

However, too many terminals are assembled in the electrical connector that often results in electromagnetic interference and thereby has a direct influence on the differential impedance of the high-speed transmission terminal group. As a result, error codes are apt to occur in process of the signal transmission of the electrical connector.

SUMMARY OF THE INVENTION

It is an object of the present invention to provide an electrical connector. The electrical connector includes an insulating body having a base portion and a tongue portion extending forward from a front of the base portion, a low-speed transmission terminal group including a plurality of electrical terminals, a high-speed transmission terminal group including at least one outputting signal terminal and at least one receiving signal terminal, and a positioning body. Each of the electrical terminals, the outputting and receiving signal terminals has a fastening strip, a contact portion and a soldering tail connected with two opposite ends of the fastening strip. The soldering tail is substantially perpendicular to the fastening strip. The fastening strips are disposed in a top surface and a bottom surface of the tongue portion respectively and spaced from one another along a direction perpendicular to the extending direction of the tongue portion. The fastening strips further pass through the base portion to make the soldering tails stretch behind the base portion and further project downward beyond a bottom of the base portion. The soldering tails of the outputting and receiving signal terminals protrude sideward to form eave boards which broaden the outputting and receiving signal terminals for lowering the differential impedance of the high-speed transmission terminal group. The positioning body has a positioning portion and a fastening portion protruding forward from the positioning portion. The positioning portion defines a plurality of positioning apertures spaced from one another and each extending vertically to penetrate therethrough. The fastening portion is mounted to the bottom of the base portion of the insulating body to make the positioning portion locate behind the base portion. The soldering tails and the eave boards are respectively inserted in the positioning apertures to be positioned and strengthened by the positioning body. Free ends of the soldering tails further project beyond a bottom of the positioning portion.

As described above, the electrical connector of the present invention utilizes the eave boards which are protruded at edges of the corresponding soldering tails of the high-speed transmission terminal group to broaden the outputting and receiving signal terminals. Such simple structures can effectively lower the differential impedance of the high-speed transmission terminal group and further prevent the electrical connector from transmitting error codes during the signal transmission thereof, when the electrical connector is in use.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
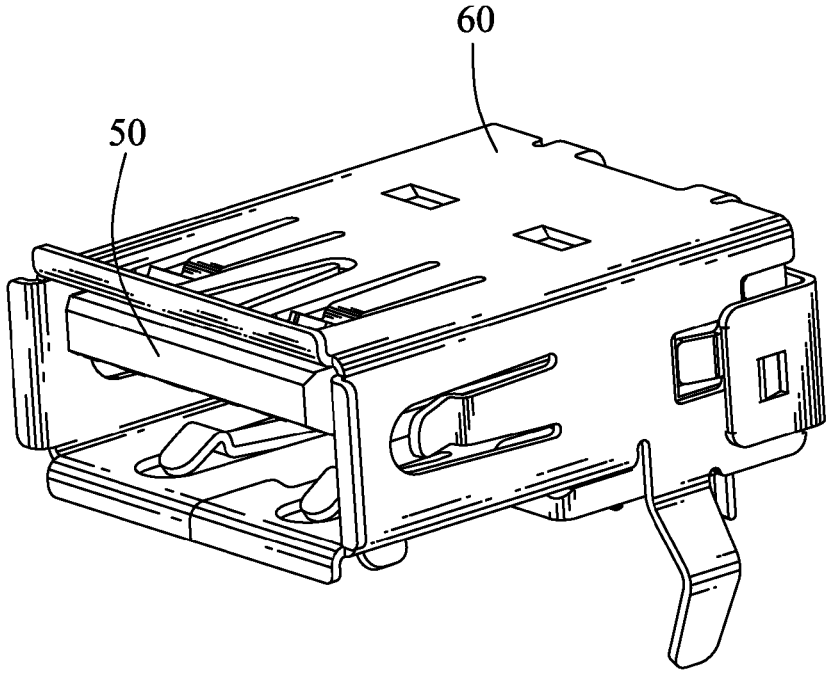
FIG. 1 is a perspective view of an electrical connector in accordance with an embodiment of the present invention.
Figure 2:
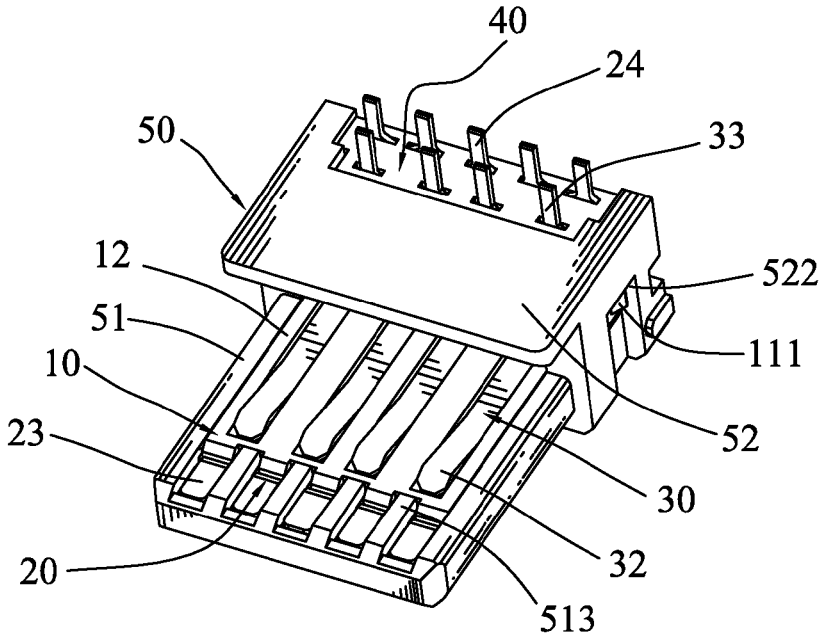
FIG. 2 is a perspective view of the electrical connector of FIG. 1 except a shielding shell.
Figure 3:
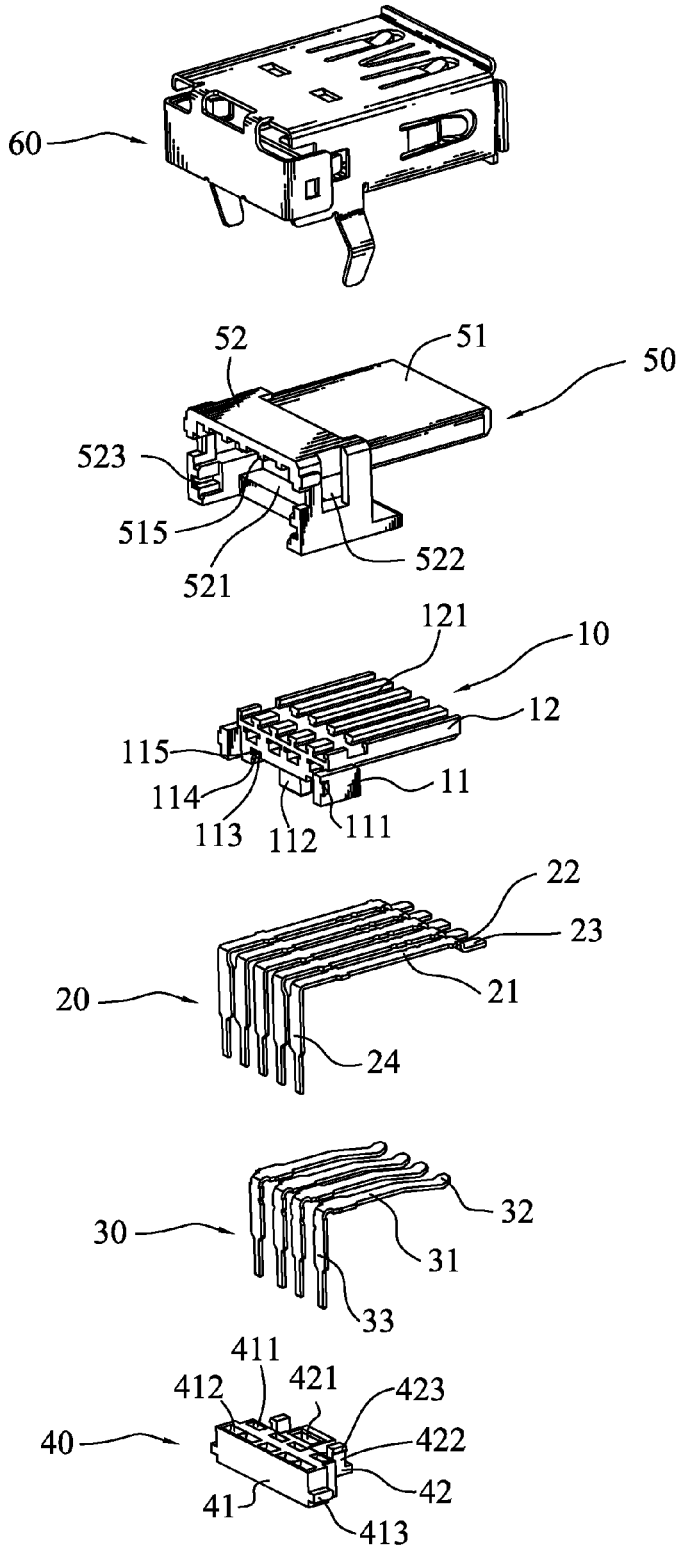
FIG. 3 is an exploded perspective view of the electrical connector of FIG. 1.

Referring to FIG. 1, FIG. 2 and FIG. 3, an electrical connector according to an embodiment of the present invention includes an insulating housing 50, an insulating body 10 mounted to the insulating housing 50, a high-speed transmission terminal group 20 disposed in the insulating body 10 and propped by the insulating housing 50, a low-speed transmission terminal group 30 disposed in the insulating body 10, a positioning body 40 mounted to a rear of the insulating body 10 for positioning and strengthening first and second soldering tails 33, 24 of the low-speed and the high-speed transmission terminal groups 30, 20, and a shielding shell 60 surrounding the insulating body 10, the insulating housing 50 and the positioning body 40.

Figure 4:
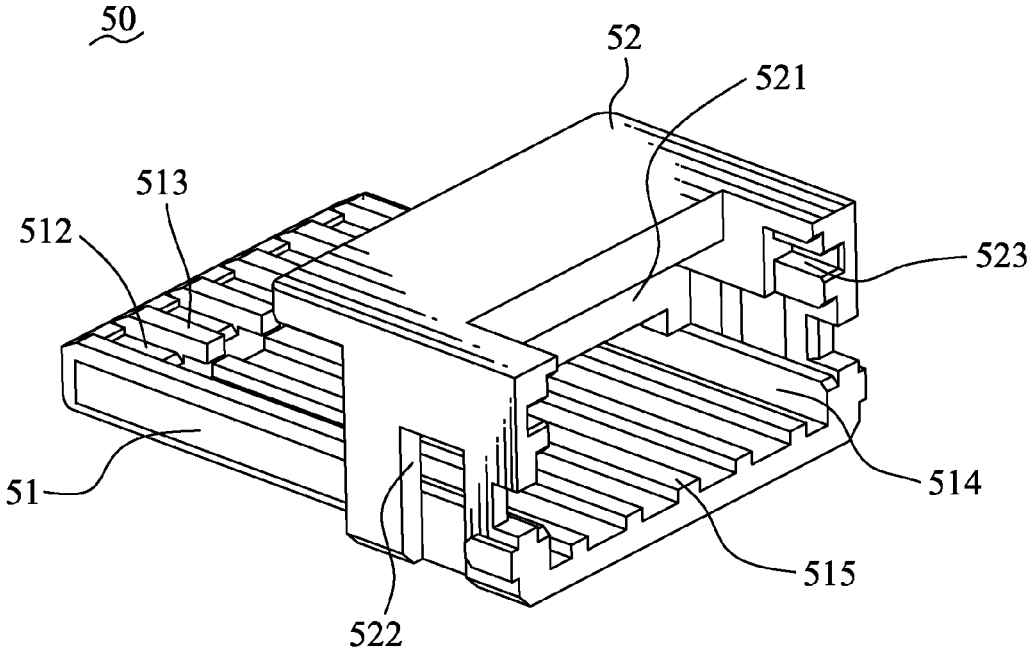
FIG. 4 is a perspective view of an insulating housing of the electrical connector of FIG. 1.

Referring to FIG. 3 and FIG. 4, the insulating housing 50 has a rectangular base body 52 and a tongue board 51 extending forward from an upper portion of a front of the base body 52. A bottom of the tongue board 51 defines a rectangular receiving recess 514 extending longitudinally to penetrate through the base body 52. A plurality of restraining ribs 515 each extending longitudinally is protruded on a top side of the receiving recess 514 and arranged at regular intervals along a transverse direction of the tongue board 51. A front end of the bottom of the tongue board 51 defines a plurality of positioning cavities 512 each extending longitudinally to be aligned with one restraining rib 515 and further communicate with the receiving recess 514. A portion between each two adjacent of the positioning cavities 512 protrudes rearward into the receiving recess 514 to form a restraining block 513. A rear of a bottom of the base body 52 defines a rectangular opening 521 connected with the receiving recess 514. A pair of locking fillisters 522 is opened in two opposite sides of the base body 52 with bottoms thereof being connected with the receiving recess 514, and a pair of fastening fillisters 523 is opened in two opposite sides of the opening 521 and penetrates through a rear end of the base body 52.

Figure 5:
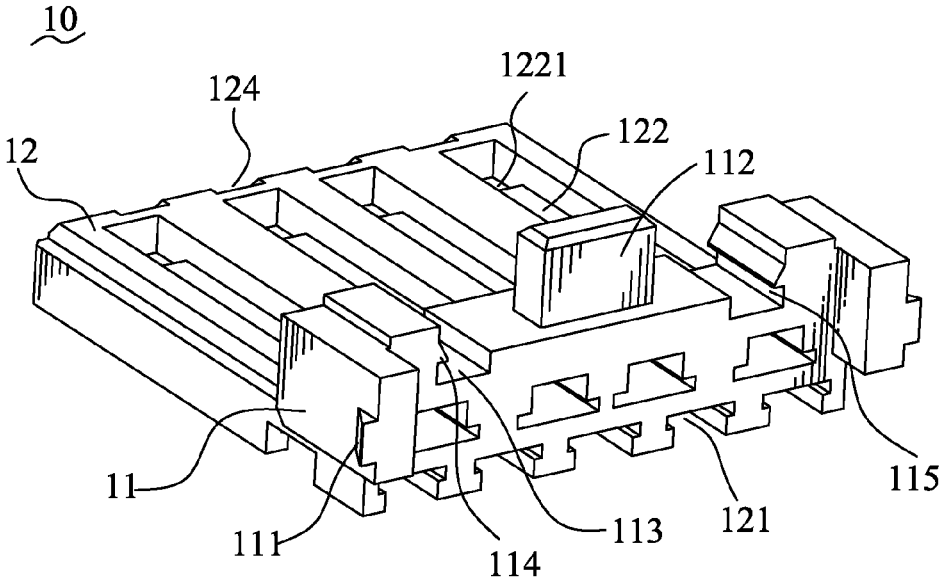
FIG. 5 is a perspective view of an insulating body of the electrical connector of FIG. 1.

Referring to FIG. 3 and FIG. 5, the insulating body 10 has a rectangular base portion 11 and a rectangular tongue portion 12 stretching forward from a top of a front of the base portion 11. A bottom surface of the tongue portion 12 defines a plurality of receiving cavities 122 arranged at regular intervals along a transverse direction of the tongue portion 12. A top surface of the tongue portion 12 defines a plurality of fastening cavities 121 arranged at regular intervals along the transverse direction of the tongue portion 12. The receiving cavities 122 and the fastening cavities 121 each extend longitudinally to penetrate through the base portion 11. A front end of each receiving cavity 122 further extends upward to form a receiving groove 1221. A plurality of restraining grooves 124 is opened in a front end of the tongue portion 12 and spaced from one another along the transverse direction of the tongue portion 12. The restraining grooves 124 have equal numbers to that of the restraining blocks 513 of the insulating housing 50. Two opposite sides of the base portion 11 oppositely protrude outward to form two locking barbs 111 at rear ends thereof. A bottom of the base portion 11 is provided with an inserting bolt 112 protruding downward from a middle portion thereof, and a pair of receiving fillisters 113 located at two opposite sides of the inserting bolt 112. A side of the receiving fillister 113 away from the inserting bolt 112 is designed with a guiding slope 114 at a substantial bottom thereof and a buckling groove 115 at a top thereof. The buckling groove 115 communicates with the receiving fillister 113. In this embodiment, the guiding slope 114 is of triangular prism shape and is located longitudinally.

Referring to FIG. 3 again, the low-speed transmission terminal group 30 includes a plurality of electrical terminals of which each has a first fastening strip 31, a first contact portion 32 and the first soldering tail 33 connected with two opposite ends of the first fastening strip 31. The first soldering tail 33 is perpendicular to the first fastening strip 31, and the first contact portion 32 is slanted beyond a plane of the first fastening strip 31 towards a same direction as the first soldering tail 33. In this embodiment, the low-speed transmission terminal group 30 includes four electrical terminals. The first fastening strips 31 are respectively disposed in the receiving cavities 122 of the insulating body 10, and the first contact portions 32 project downward out of the corresponding receiving cavities 122. When an external mating connector is inserted into the electrical connector of the present invention, the first contact portions 32 are respectively pressed into the receiving grooves 1221. The first soldering tails 33 are located behind the base portion 11 and aligned with one another to parallel a rear surface of the base portion 11.

Figure 7:
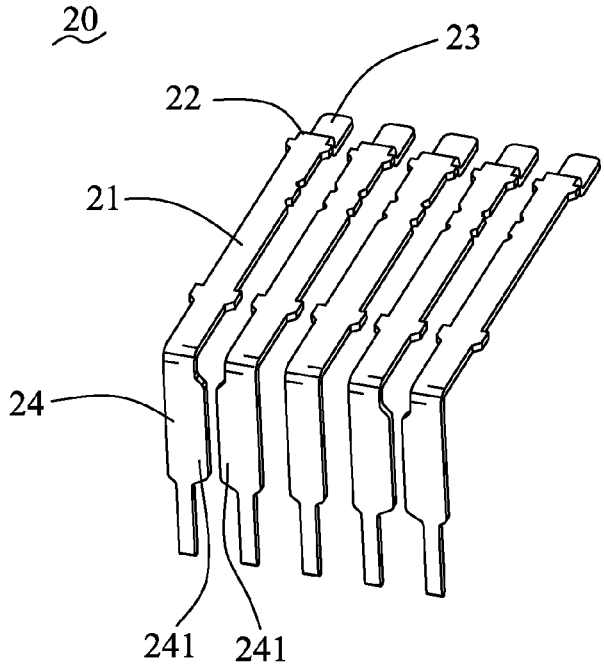
FIG. 7 is a perspective view of a high-speed transmission terminal group of the electrical connector of FIG. 1.

Referring to FIG. 3 and FIG. 7, the high-speed transmission terminal group 20 includes a pair of outputting signal terminals (not labeled), a pair of receiving signal terminals (not labeled) and a grounding terminal (not labeled), of which each has a second fastening strip 21, a second contact portion 23 and the second soldering tail 24 connected at two opposite ends of the second fastening strip 21. The second contact portion 23 is connected with the second fastening strip 21 in a step manner by a connecting portion 22. The second soldering tail 24 is perpendicular to the second fastening strip 21 towards a same direction as the connecting portion 22. The second fastening strips 21 are respectively secured in the fastening cavities 121 of the insulating body 10. The second contact portions 23 project beyond the front end of the tongue portion 12 with the connecting portions 22 abutting against the front end of the tongue portion 12. The second soldering tails 24 are located behind the base portion 11 and aligned with one another to parallel the rear surface of the base portion 11. The second soldering tails 24 are farther away from the base portion 11 than the first soldering tails 33, in other words, the first soldering tails 33 are substantially located between the second soldering tails 24 and the base portion 11. In the embodiment, the grounding terminal is located between the pair of outputting signal terminals and the pair of receiving signal terminals. The second soldering tails 24 of the pair of outputting signal terminals protrude towards each other to form an eave board 241 respectively, and the second soldering tails 24 of the pair of receiving signal terminals also protrude towards each other to form the eave board 241 respectively. Because the shape of a terminal generally has a direct influence on the impedance of the terminal, so the eave boards 241 formed at tops of the second soldering tails 24 actually broaden the outputting signal terminals and the receiving signal terminals, and effectively lower the differential impedance of the high-speed transmission terminal group 20.

Figure 6:
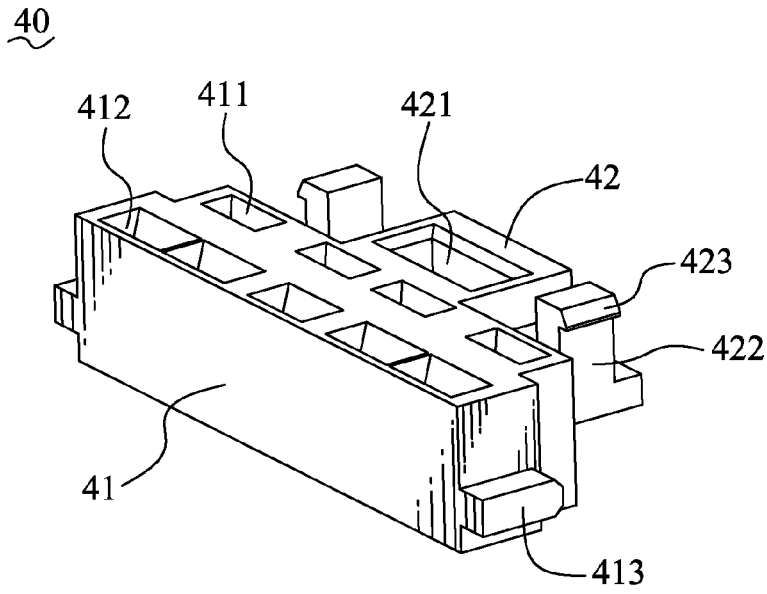
FIG. 6 is a perspective view of a positioning body of the electrical connector of FIG. 1.

Referring to FIG. 3 and FIG. 6, the positioning body 40 has a rectangular positioning portion 41, and a fastening portion 42 protruding forward from a front of the positioning portion 41. Two opposite sides of the positioning portion 41 oppositely protrude outward to form a pair of fastening ears 413 corresponding to the fastening fillisters 523 of the insulating housing 50. The positioning portion 41 defines a plurality of first positioning apertures 411 spaced from and aligned with one another along a direction perpendicular to the extending direction of the fastening portion 42, and a plurality of second positioning apertures 412 arranged at regular intervals in a row parallel the alignment of the first positioning apertures 411. Each of the first and the second positioning apertures 411, 412 extends vertically to penetrate through the positioning portion 41. The row of first positioning apertures 411 are closer to the fastening portion 42 than the row of second positioning apertures 412, and located between the fastening portion 42 and the row of second positioning apertures 412. The fastening portion 42 are designed with an inserting hole 421 vertically penetrating through a middle thereof, and a pair of elastic arms 422 formed by two opposite ends of a bottom thereof oppositely protruding outward and then extending upward. Two top ends of the pair of elastic arms 422 oppositely protrude outward to form two buckling barbs 423.

Referring to FIG. 2 and FIG. 3, when the positioning body 40 is mounted to the base portion 11 of the insulating body 10, the first soldering tails 33 and the second soldering tails 24 are respectively inserted into the first positioning apertures 411 and the second positioning apertures 412. Then the positioning body 40 is further pushed upward to make the inserting bolt 112 insert in the inserting hole 421 and the top ends of the elastic arms 422 be received in the corresponding receiving fillisters 113, until the buckling barbs 423 slide upward along the guiding slopes 114 to be respectively buckled in the buckling grooves 115. At this time, the fastening portion 42 is against the bottom of the base portion 11 to ensure a firm assembly between the positioning body 40 and the insulating body 10. The positioning portion 41 is located behind the base portion 11 to make the first and the second soldering tails 33, 24 be firmly positioned in the respective first and second positioning apertures 411, 412, wherein the eave boards 241 of the outputting and receiving signal terminals are also positioned in the respective second positioning apertures 412, and free ends of the first and the second soldering tails 33, 24 project beyond a bottom of the positioning portion 41.

Referring to FIGS. 1-7 again, when the insulating body 10 with the terminal groups 20, 30 and the positioning body 40 is assembled to the insulating housing 50, the tongue portion 12 is inserted forward into the receiving recess 514 until the restraining blocks 513 are respectively received in the restraining grooves 124 to restrain the insulating body 10 further moving forward. At this time, the connecting portions 22 of the high-speed transmission terminal group 20 are clipped between the front end of the tongue portion 12 and a front side of the receiving recess 514, and the second contact portions 23 are positioned in the positioning cavities 512 respectively. The restraining ribs 515 are inserted in the fastening cavities 121 respectively to further restrain the corresponding second fastening strips 21 in the respective fastening cavities 121. The base portion 11 is fastened in a rear of the receiving recess 514 by means of the locking barbs 111 being buckled in the corresponding locking fillisters 522 to prevent the insulating body 10 from moving rearward. The positioning body 40 is secured in the opening 521 of the insulating housing 50 by means of the fastening ears 413 being buckled in the fastening fillisters 523 respectively. The free ends of the first and the second soldering tails 33, 24 of the terminal groups 30, 20 further stretch out of the opening 521 and beyond the bottom of the base body 52 for being inserted into and soldered with a printed circuit board (not shown). The shielding shell 60 surrounds the insulating housing 50 so that not only can protect the insulating body 10, the positioning body 40, the insulating housing 50 and the terminal groups 20, 30 from harm, but also can shield the terminal groups 20, 30 from static electricity.

As described above, the electrical connector of the present invention utilizes the eave boards 241 which are protruded at edges of the corresponding second soldering tails 24 to broaden the outputting and receiving signal terminals. Such simple structures can effectively lower the differential impedance of the high-speed transmission terminal group 20 and further prevent the electrical connector from transmitting error codes during the signal transmission thereof, when the electrical connector is in use.

What is claimed is:

1. An electrical connector, comprising:

an insulating body having a base portion and a tongue portion extending forward from a front of the base portion;

a low-speed transmission terminal group including a plurality of electrical terminals;

a high-speed transmission terminal group including at least one outputting signal terminal and at least one receiving signal terminal, each of the electrical terminals, the outputting and receiving signal terminals having a fastening strip, a contact portion and a soldering tail connected with two opposite ends of the fastening strip, the soldering tail being substantially perpendicular to the fastening strip, the fastening strips being disposed in a top surface and a bottom surface of the tongue portion respectively and spaced from one another along a direction perpendicular to an extending direction of the tongue portion, the fastening strips further passing through the base portion to make the soldering tails stretch behind the base portion and further project downward beyond a bottom of the base portion, the soldering tails of the outputting and receiving signal terminals protruding sideward to form eave boards which broaden the outputting and receiving signal terminals for lowering the differential impedance of the high-speed transmission terminal group; and a positioning body having a positioning portion and a fastening portion protruding forward from the positioning portion, the positioning portion defining a plurality of positioning apertures spaced from one another and each extending vertically to penetrate therethrough, the fastening portion being mounted to the bottom of the base portion of the insulating body to make the positioning portion locate behind the base portion, the soldering tails and the eave boards being respectively inserted in the positioning apertures to be positioned and strengthened by the positioning body, free ends of the soldering tails further projecting beyond a bottom of the positioning portion;

wherein the fastening strips of the high-speed transmission terminal group are fastened in the top surface of the tongue portion and each contact portion thereof is connected with one end of the corresponding fastening strip in a step manner by a connecting portion which abuts against a front end of the tongue portion to make the contact portion stretch beyond the front end of the tongue portion;

wherein the electrical connector further comprising an insulating housing which has a base body and a tongue board extending forward from an upper portion of a front of the base body, a bottom of the tongue board defining a receiving recess extending longitudinally to penetrate through the base body, a rear of a bottom of the base body defining an opening connected with the receiving recess, the tongue portion of the insulating body being inserted forward in the receiving recess to make the contact portions of the high-speed transmission terminal group be positioned against a front of the bottom of the tongue board, the connecting portions being clipped between the front end of the tongue portion and a front side of the receiving recess, the base portion being fastened in a rear of the receiving recess and the positioning body being secured in the opening, the free ends of the soldering tails further stretching beyond the bottom of the base body.

2. The electrical connector as claimed in claim 1, wherein two opposite ends of a bottom of the fastening portion oppositely protrude outward and then extend upward to form a pair of elastic arms of which top ends oppositely protrude outward to form a pair of buckling barbs, two sides of the bottom of the base portion define a pair of receiving fillisters of which two outmost sides each is provided with a guiding slope at a substantial bottom thereof and a buckling groove at a top thereof, the fastening portion of the positioning body is mounted to the bottom of the base portion by means of the top ends of the elastic arms being inserted in the corresponding receiving fillisters and the buckling barbs sliding upward along the guiding slopes to be buckled in the buckling grooves.

3. The electrical connector as claimed in claim 2, wherein an inserting hole is opened to vertically penetrate through a middle of the fastening portion, a middle portion of the bottom of the base portion protrudes downward to form an inserting bolt inserted in the inserting hole.

4. The electrical connector as claimed in claim 1, wherein the high-speed transmission terminal group further includes a grounding terminal located between the outputting signal terminal and the receiving signal terminal, the grounding terminal has a similar structure to the outputting and receiving signal terminals without the eave boards.

5. The electrical connector as claimed in claim 1, wherein the soldering tails of the high-speed transmission terminal group and the soldering tails of the low-speed transmission terminal group are arranged to two rows each paralleling a rear surface of the base portion, the positioning apertures of the positioning body are divided into two rows parallel to each other and perpendicular to the extending direction of the fastening portion for corresponding to the soldering tails.

6. The electrical connector as claimed in claim 1, wherein a plurality of restraining ribs each extending longitudinally is protruded on a top side of the receiving recess to abut against and restrain the corresponding fastening strips of the high-speed transmission terminal group in the top surface of the insulating body.

7. The electrical connector as claimed in claim 1, wherein two opposite sides of the base portion oppositely protrude outward to form two locking barbs, a pair of locking fillisters is opened in two opposite sides of the base body of the insulating housing with bottoms being connected with the receiving recess, the locking barbs are buckled in the bottoms of the locking fillisters respectively to prevent the insulating body from moving rearward.

8. The electrical connector as claimed in claim 1, wherein a pair of fastening fillisters is opened in two opposite sides of the opening and penetrates through a rear end of the base body, two opposite sides of the positioning portion of the positioning body oppositely protrude outward to form a pair of fastening ears buckled in the fastening fillisters respectively.

9. The electrical connector as claimed in claim 1, wherein a plurality of restraining grooves is opened in the front end of the tongue portion and spaced from one another, a front side of the receiving recess protrudes rearward to form a plurality of restraining blocks respectively received in the restraining grooves to restrain the insulating body further moving forward.

10. The electrical connector as claimed in claim 1, wherein the fastening strips of the low-speed transmission terminal group are fastened in the bottom surface of the tongue portion and the contact portions thereof are slanted downward beyond the bottom surface of the tongue portion.

11. The electrical connector as claimed in claim 10, wherein the bottom surface of the tongue portion defines a plurality of receiving cavities each extending longitudinally to penetrate through the base portion for fastening the corresponding fastening strip of the low-speed transmission terminal group therein, a front end of each receiving cavity further extends upward to form a receiving groove for receiving the contact portion of the low-speed transmission terminal group.

* * * * *